US006465404B2

(12) United States Patent
Scriven, II et al.

(10) Patent No.: US 6,465,404 B2
(45) Date of Patent: Oct. 15, 2002

(54) AQUEOUS CLEANING COMPOSITION WITH CONTROLLED PH

(75) Inventors: Herman Scriven, II; Robert G. Baker, both of Tampa, FL (US); Garland Corey, Milltown, NJ (US)

(73) Assignee: BBJ Environmental Solutions, Inc., Tampa, FL (US)

( * ) Notice: Subject to any disclaimer, the term of this patent is extended or adjusted under 35 U.S.C. 154(b) by 0 days.

(21) Appl. No.: 09/811,582

(22) Filed: Mar. 20, 2001

(65) Prior Publication Data

US 2002/0016281 A1 Feb. 7, 2002

Related U.S. Application Data

(60) Provisional application No. 60/190,935, filed on Mar. 21, 2000.

(51) Int. Cl.[7] ..... C11D 1/72; C11D 3/24; C11D 3/43; C11D 3/44

(52) U.S. Cl. ..... 510/184; 510/185; 510/247; 510/255; 510/257; 510/264; 510/265; 510/499; 510/500

(58) Field of Search ..... 510/183, 184, 510/185, 247, 255, 257, 264, 265, 499, 500

(56) References Cited

U.S. PATENT DOCUMENTS

| | | | | |
|---|---|---|---|---|
| 3,663,445 A | | 5/1972 | Augustin et al. | |
| 4,414,128 A | * | 11/1983 | Goffinet | 252/111 |
| 5,252,245 A | | 10/1993 | Garabedian, Jr. et al. | |
| 5,465,685 A | | 11/1995 | Dotolo et al. | |
| 5,556,833 A | | 9/1996 | Howe | |
| 5,733,377 A | * | 3/1998 | Howe | 134/3 |
| 6,001,793 A | | 12/1999 | Figdore et al. | |

* cited by examiner

*Primary Examiner*—Gregory Delcotto
(74) *Attorney, Agent, or Firm*—Browdy and Neimark

(57) ABSTRACT

Aqueous cleaning compositions in which the pH is controlled comprise an acidic metal cleaning compound; at least one nitrogen containing compound to provide a stabilized pH; an emulsifier, a nonionic surfactant and optionally at least one water soluble solvent having a vapor pressure of less than 4 mm Hg at 20° C.

14 Claims, No Drawings

AQUEOUS CLEANING COMPOSITION WITH CONTROLLED PH

This application claims the benefit of Provisional application Ser. No. 60/190,935, filed Mar. 21, 2000.

FIELD OF THE INVENTION

The present invention relates to aqueous cleaning compositions in which the pH can be adjusted to provide efficient cleaning and unique safety for the user and the surface to be treated.

BACKGROUND OF THE INVENTION

Cleaning of industrial machinery and equipment, such as metal coils, can present problems because of the many different materials used to make such equipment. Any cleaning composition used must therefore not only clean properly, but must also avoid causing damage to the various components and to the various materials in the components of the equipment.

Several cleaning compositions have been formulated for use in cleaning various metals. Unfortunately, many cleaners that have been found to be good at brightening and removing soil have also been linked to problems with damaged surfaces, particular with cleaning coils. However, none of these compositions provides for an adjustable pH to provide efficient cleaning and safety to the user as well as to the materials cleaned.

Garabadian et al., in U.S. Pat. No. 5,252,245, disclose an aqueous cleaner for hard surfaces such as glass windows comprising an alkanol solvent, a surfactant, and a buffering system. In this case the buffer is used to reduce streaking and filming of hard surfaces.

Howe et al., in U.S. Pat. No. 5,556,833, disclose an aqueous cleaning composition for cleaning soils from surfaces of painted steel and the like. This cleaning composition comprises at least one acid fluoride salt such as ammonium bifluoride, a nonionic surfactant, and a terpene. The pH of the composition is from about 3.0 to 6.5, but there is no provision for adjusting the pH of the composition.

Fidgore et al., in U.S. Pat. No. 6,001,793, disclose a cleaning composition comprising at least one terpene solvent, a nonionic surfactant, and an anti-corrosion agent such as triethanolamine. The pH of this composition is preferably less than about 9.5.

SUMMARY OF THE INVENTION

It is an object of the present invention to overcome deficiencies in the prior art.

It is another object of the present invention to provide an aqueous cleaning composition that has a pH which can be adjusted to between about 3.5 and 7.0.

It is a further object of the present invention to provide an aqueous cleaning composition which is particularly useful in cleaning metals and combinations of metals and non-metals with minimal corrosion effects, particularly on aluminium.

According to the present invention, an aqueous cleaning composition is provided based upon an acidic metal salt such as ammonium bifluoride in which the pH of the composition can be controlled by addition of a nitrogen compound such as an ethanolamine, EDTA, or NTA. By adding such a nitrogen compound, one can adjust the pH of the composition to be best suited to the substrate to be cleaned.

More particularly, the aqueous cleaning compositions of the present invention include water, an acidic metal cleaning compound, at least one nitrogen containing compound, a nonionic surfactant, and an emulsifying agent. Additional water soluble solvents which have a vapor pressure of less than about 4 mmHg at 20° C. may optionally be included. A typical formulation can include ammonium bifluoride, a terpene emulsifying agent, an alkyl phenol nonionic surfactant, an alkanolamide an an alkanolamine for pH stabilization.

DETAILED DESCRIPTION OF THE INVENTION

The aqueous cleaning composition of the present invention is particularly well suited for cleaning cooling coils, but is not limited thereto. Cooling coils must be cleaned periodically to remove deposits which can build up on the surface of the coils and interfere with proper system operations. The pH of the cleaning composition of the present invention can be adjusted as needed.

The compositions of the present invention remove dirt and other deposits from metal surfaces, particularly from cooling coils. These compositions effectively clean and deodorize surfaces such as evaporator coils, condenser coils, window units, air filters, blowers, and other dirty HVAC surfaces, as well as any other type of metal or non-metal equipment. Because the cleaning compositions of the present invention contain no free acid, they will not etch metals such as aluminum. This is particularly important in cleaning evaporator coils because, if the metal surfaces of evaporator coils are etched, there may be water blow off on the evaporator coil, which in turn can cause microbial contamination downstream.

The primary active ingredient in the aqueous cleaning composition of the present invention is an acidic metal cleaning compound. While ammonium bifluoride is the preferred acidic metal cleaning compound for use in cleaning compositions according to the present invention, other fluoride salts can be used in the compositions. Other metal salts that can be used include alkali metal fluorides and ammonium fluorides. Specific fluoride salts include potassium bifluoride, sodium bifluoride, ammonium fluorides, calcium fluorophosphates, sodium fluorosilicates, and the like. These compounds are used in amounts ranging from about 0.1% to about 10% by weight.

The preferred solvent is a nonionic surfactant such as a nonylphenol polyglycol ether. However, other suitable nonionic surfactants can be used, including other ethoxylated alcohols such as condensation products of ethylene oxide with an organic compound containing an active hydrogen bound to oxygen or nitrogen atoms. Suitable nonionic surfactants include, but are not limited to, alkoxylated compounds produced by condensing alkylene oxide groups (which are hydrophilic in nature) with an organic hydrophobic compound, which may be aliphatic, aromatic, or aryl aromatic. Non-limiting examples of suitable nonionic surfactants also include polyethylene oxide condensates of alkyl phenols, i.e., condensation products of alkyl phenols having an alkyl group containing from 6 to 12 carbon atoms in either a branched chain or a straight chain configuration, with ethylene oxide being present in amounts equal to about 5 to about 25 moles of ethylene oxide per mole of alkyl phenol. The alkyl substituent in such compounds may be derived, for example, from polymerized propylene, diisobutylene, octene, and nonene. Other examples include dodecylphenol condensed with 12 moles of ethylene oxide per mole of phenol; dinonylphenol condensed with 15 moles of ethylene oxide per mole of phenol; nonylphenyl and di-iso-isooctylphenol condensed with 15 moles of ethylene oxide.

Further examples of suitable nonionic surfactants are the condensation products of primary or secondary aliphatic alcohols having from 8 to 24 carbon atoms, in straight chain or branched chain configuration, with about 1 to about 30 moles of alkylene oxide per mole of alcohol. Preferably, the aliphatic alcohol comprises between about 9 and about 15 carbon atoms and is ethoxylated with between about 2 and about 23, preferably between 3 and 9, moles of ethylene oxide per mole of aliphatic alcohol.

Other nonionic compounds that can be used in the present invention can be prepared by condensing ethylene oxide with a hydrophobic base formed by the condensation of propylene oxide with either propylene glycol or ethylene diamine.

Other suitable solvents include tripropylenemethyl ether (TPM), gamma butyrolactone (GBL), and pyrrolidones such as N-methyol-2-pyrrolidone.

The preferred nitrogen containing compounds for use in compositions of the present invention are alkanolamides, such as coconut diethanolamide, modified. Other suitable alkanolamides include lauric/myristic monoethanolamide, coconut monoethanolamide, lauric diethanolamide, unmodified coconut diethanolamide, and other modified fatty alkanolamides. Other suitable nitrogen containing compounds that fit the chemical vapor pressure profile are pyrrolidones such as N-methyl-2-pyrrolidone (NMP). These compounds increase the cleaning ability of the compositions and increase the viscosity of the compositions, which includes the "cling time" to the substrate being cleaned.

Other nitrogen containing compounds that can be used in the compositions of the present invention included di-tri, and tetra sodium salts of ethylene diamine tetra acetic acid. Furthermore, modified imidazole derivatives such as sodium cocoamphoacetate can be used.

An emulsifier can be used to ensure that the compositions remain clear upon dilution. A preferred emulsifier is a terpene emulsifying agent.

The pH of the compositions is adjusted to the desired level between about 3.5 and about 7.0 by adding at least one nitrogen containing compound. Alkanolamines such as triethanolamine can be used, particularly short chain, e.g., $C_1$–C6 alkanolamines such as mono-, di- and triethanolamines, which may be used alone or in admixture with each other or with other alkanolamines. Other such compounds for pH adjustment include compounds such as di-, tri-, and tetra sodium salts of ethylene diamine triacetic acid (EDTA) and nitrilotriacetic acid (NTA), alone or in combination with alkanolamides of $C_1$–$C_6$ alcohols and modified imidazoline derivatives.

The following examples are provided to illustrate the present invention, but are in no way intended to limit the invention.

Several 200 gram batches of cleaning solutions were prepared, and their cleaning efficacies were tested, with 5 being excellent, 1 being poor.

| Material | Example A grams | Example B grams | Example C grams |
|---|---|---|---|
| Water | 148 | 176.8 | 182.4 |
| Ammonium bifluoride | 8.0 | 3.4 | 3.4 |
| Sodium Cocoamphoacetate | 8.0 | 3.4 | 3.4 |
| EDTA | 8.0 | 3.4 | 3.4 |
| Tripropylene methyl ether | 14.0 | 6.0 | 0 |
| Triethanolamnine | 14.0 | 6.0 | 6.0 |
| Coconut diethanolamine, modified | 0 | 0 | 1.4 |
| pH | 7.0 | 6.2 | 6.0 |
| Cleaning efficacy | 3 | 2 | 2 |

It was found, however, that the following formulation provided superior cleaning efficacy:

EXAMPLE D

| Material | % by Weight |
|---|---|
| Water | 88.25 |
| Ammonium bifluoride | 4.0 |
| Nonyl phenol ethoxylate | 4.0 |
| Terpene emulsifying agent | 3.0 |
| Coconut diethanolamide, modified | 0.75 |

The pH of this formulation was 5.0, and the cleaning efficacy was 5, or excellent.

The composition of Example D was tested by soaking a cooling coil for 24 hours in a 1:3 water dilution of the composition. After 24 hours, the coil was examined and it was noted that the grooves of the coil were maintained and that the brightness of the metal was still prevalent. That is, after contact with a concentrated solution for 24 hours, the metal was not etched.

In a further test, the composition of Example D was compared with Acti-Brite, a commercially available cleaner for cooling coils, the active ingredients of which are phosphoric acid and hydrofluoric acid, manufactured by Virginia KMP Corporation of Dallas, TX, to determine weight loss of aluminum coil fins. Acti-Brite is the best currently available coil cleaning composition.

Two coil-fin coupons were cleaned with alcohol and weighed. The initial weights were as follows:

Example D 1.35 grams

Acti-Brite 1.26 grams

Both compositions were diluted 1:3 with water and the coil-fin coupons were soaked for 2.5 hours in the diluted compositions.

The final weights were as follows:

Example D 1.34 grams

Acti-Brite 0.45 grams

The coil-fin coupon cleaned with the formulations of Example D remained virtually identical throughout the testing. However, the coil-fin coupon cleaned with Acti-Brite lost over half of its surface and turned black; it was also very brittle.

It was found that reducing the surface tension of the composition helps the spreading and contact between the cleaner and the surface to be cleaned. Thus, a fluorosurfactant can be added in very small quantities to reduce the surface tension of the compositions.

The diluted (1:3) solution was stored in a plastic container at room temperature for 24 hours. After this period there was no fallout and the solution remained clear.

When a 1:3 dilute solution of the composition of Example D was sprayed onto a cooling coil and permitted to penetrate for 5–6 minutes, the results were as good as when using the best available coil cleaning composition.

Four samples from the same batch of Example D were taken. One sample was maintained at ambient temperature (25° C.), one sample was placed into an incubator at 38° C. and cooler at 5° C., and one sample was placed into a freezer. After the sixth day, the samples were removed and examined. The sample that had been placed into the incubator and cooler did not cloud or show any evidence of a precipitate fallout. The sample from the freezer was permitted to thaw. The samples were then diluted 1:3 with water and were tested for cleaning vs. the control. The results were all equal, and it was demonstrated that temperature did not affect the cleaning capability of this formulation.

When the formulation of Example D was diluted 1:5 with water, its cleaning efficacy was rated at 4–5, i.e., approximately excellent.

In order to determine the effect of ammonium bifluoride concentration on cleaning, several formulations were made using a range of percentages of ammonium bifluoride.

| Material | Example E | Example F | Example G | Example H | Example I |
|---|---|---|---|---|---|
| Water | 88 | 89 | 90 | 91 | 92 |
| Ammonium bifluoride | 4 | 3 | 2 | 1 | 0 |
| Nonyl phenol ethoxylate | 4 | 4 | 4 | 4 | 4 |
| Terpene emulsifying agent | 3 | 3 | 3 | 3 | 3 |
| Coconut diethanolamide, modified | 1 | 1 | 1 | 1 | 1 |
| pH | 4.59 | 5.10 | 5.07 | 5.03 | 9.44 |
| Cleaning efficacy | 5 | 4 | 3–4 | 3 | 1 |

While the amount of ammonium bifluoride in the composition moderately affects the cleaning ability of the composition, as well as the pH of the composition, the aqueous cleaning composition is still acceptable at a 1% concentration. Interestingly, no matter what the concentration of the ammonium bifluoride, the other components of the composition help to maintain a constant pH.

EXAMPLE J

In order to obtain another effective aqueous cleaning composition which can be diluted 1:3 and 1:5 with water, while maintaining the cost parameters for the raw materials, the amount of modified coconut alkylolamide was increased slightly:

| Material | % by Weight |
|---|---|
| Water | 86.75 |
| Ammonium bifluoride | 4 |
| Nonyl phenol ethoxylate | 4 |
| Terpene emulsifying agent | 4 |

-continued

| Material | % by Weight |
|---|---|
| Coconut diethanolamide, modified pH 5.0 | 1.25 |

When the formulation of Example J was diluted 1:5 with water, it had very good cleaning ability. The concentrated formula has increased viscosity and slightly higher foaming than previously described formulations.

EXAMPLE K

Another particularly efficacious aqueous cleaning composition was made from the following:

| Material | % by Weight |
|---|---|
| Water | 76 |
| Ammonium bifluoride | 5.2 |
| Terpene emulsifying agent | 17.8 |
| Coconut diethanolamide, modified | 0.8 |
| pH | 6.5 |

The composition of Example K was more viscous in both concentrated and dilute forms than previously described compositions. The increased foaming action is apparent in both soak testing and regular application. This formulation is stable.

EXAMPLE L

An aqueous cleaning composition was formulated from the following:

| Material | % by Weight |
|---|---|
| Water | 88.5 |
| Ammonium bifluoride | 4 |
| Terpene emulsifying agent | 3 |
| Coconut diethanolamide, modified | 5 |
| pH | 5.3 |

Even more economical compositions were formulated as follows:

| Material | Example M, grams | Example N, grams |
|---|---|---|
| Water | 176.8 | 182.4 |
| Ammonium bifluoride | 3.4 | 3.4 |
| Sodium amphoacetate | 3.4 | 3.4 |
| EDTA | 3.4 | 3.4 |
| TPM | 6.0 | 6.0 |
| Coconut diethanolamide, modified | 0 | 1.4 |

Additional aqueous cleaning compositions were formulated using a variety of ingredients as follows:

| Material | Example O | Example P | Example Q | Example R |
|---|---|---|---|---|
| Ammonium bifluoride | 5.0 | 0.05 | 0.005 | 0.001 |
| Sodium Cocoamphoacetate | 4.0 | 0.04 | 0.004 | 0.0008 |
| Seaquest 100 EDTA | 4.0 | 0.04 | 0.004 | 0.0008 |
| Triethanol amine | 7.0 | 0.07 | 0.007 | 0.0014 |

Water: q.s. to 100%

The compositions of the present invention can be pH adjusted with an alkanol amine in order to provide the most effective and safe aqueous cleaning compositions for a variety of surfaces. The compositions can be used on a variety of metal with little danger of etching the metals or otherwise destroying the surfaces cleaned.

A study was conducted to determine the amount of damage, if any, an aqueous cleaning composition according to the present invention would cause in comparison with conventional coil cleaning solutions. Weight loss and damage were assessed on three aluminum coupons soaked for 2.5 hours in each solution 1:#.

Procedure

Equal sized, clean aluminum coupons were selected. All coupons were pre-cleaned with alcohol, air dried, and initial weight measurements were taken. Each coupon was then allowed to soak in a designated solution for a period of 2.5 hours, totally submerged. After the soaking period, each coupon was rinsed and was allowed to air dry. The final weight measurements were then taken

TABLE A

RESULTS

| | Example J | 4% ABF SOLUTION | ACTI-BRITE (1:3 dilution) |
|---|---|---|---|
| TOTAL HF (1:3) (%) | 1.00% | 1.33% | 5% |
| INITIAL (g) | 1.35 | 1.51 | 1.26 |
| FINAL (g) | 1.34 | 1.34 | 0.45 |
| WEIGHT LOSS (%) | 0.7% | 11.3% | 64.3% |

Discussion

In reviewing the results, the composition of Example J showed the lowest weight loss percentage of all cleaning solutions tested, with a loss value of less than 1%. It is important to note that the scale used in order to take measurements was only accurate to 0.01 g, so there may not have been any variations in the initial and final measurements. The importance of the compositions of the present invention is evident when comparing the weight loss differences with the other two solutions. While we do not exactly know the mode of action, we hypothesize that the compositions of the present invention bind the ammonium biflouride (ABF) and inhibit the conversion to hydrogen fluoride (HF), which is the main contributor to pitting and etching of an aluminum surface, they do not etch the metal surface. Acti-Brite caused extensive damage to the aluminum surface, it destroyed over 64% of the aluminum surface in 2.5 hours. The 4% ABF Solution destroyed 11% of the aluminum surface in 2.5 hours. After microscopic examination, the composition of Example J showed no signs of damage to the aluminum, the 4% ABF Solution revealed evidence of moderate pitting, while the Acti-Brite solution severely damaged and corroded the remaining portion of the aluminum coupon.

Conclusion

Of all the tested products, there is evidence that the composition of the present invention, as exemplified by Example J, showed an insignificant loss to the metal surface. The comparison with the 4% ABF solution demonstrates that there are unique properties in the formulation of the present invention, which protects the integrity of the aluminum surface from significant damage. This property, in addition to the demonstrated cleaning ability, further shows the uniqueness of compositions according to the present invention.

Studies were conducted to provide information on short term exposure to compositions according to the present invention.

Evaluation Description

The Test Objective was to determine if hydrofluoric acid emissions from a new formulation of aqueous coil cleaner, the composition of Example J, could pose a hazard to users or building occupants. By using a small chamber to contain the vaporous emissions generated during a simulated coil cleaning, the amount of hydrofluoric acid that was generated could be determined. This test was designed to measure HF emissions even if they were influenced by the actions inherent to coil cleaning. Materials and procedures were in accordance with guidance set forth in *ASTM Standard D* 5116-97 *Standard Guide for Small-Scale Environmental Chamber Determinations of Organic Emissions From Indoor Materials/Products.*

This study determined the emissions of vaporous HF from the coil cleaner during simulated use. The study was designed to determine the potential for inhalation exposure. Total exposure includes inhalation, skin and eye contact, and oral ingestion. These other routes of exposure were evaluated in the accompanying product safety laboratory studies.

Exposures to HF were estimated based upon the results of these chamber tests. Because the analytical method was unable to even detect HF emissions from the product of the present invention, its HF emissions must be estimated. This estimate is presented as a range from as low as the predicted amount to as high as the lowest detectable amount. Hydrofluoric Acid emission therefore ranges from 0.027 $\mu$g HF/ml to 0.13 $\mu$g HF/ml of solution.

Two categories of exposure were examined. The first category was the worker who performs the coil cleaning. The second category was building occupants after coil cleaner usage. Since all possible exposure scenarios cannot be assessed, those that present the greatest possible exposure are examined. If these highest exposure scenarios are determined to not pose a risk of acute or chronic adverse health effects then lesser exposures can be assumed to pose a lower risk.

When the HF emission values are applied to an exposure model, that can estimate an individual's exposure, then a maximum exposure can be estimated that ranges from 0.13 mg/m$^3$ (0.158 ppm) to 0.62 mg/m$^3$ (0.76 ppm). This concentration is 100 to 21 times lower than the concentration expected to cause irritation (13 mg/m$^3$ or 15.8 ppm) if a person were exposed for greater then 10 minutes. These concentrations are substantially (~20× to ~4×) lower than the OSHA Permissible Exposure Limit (PEL) (2.5 mg/m$^3$ or 3 ppm) concentration, where no acute health effects are observed for 8-hour exposures.

Since the exposure is longer for building occupants where the coil cleaner may be used, an exposure and dose estimate was performed. This exposure was calculated under worst-case conditions with no ventilation with outside air, assuming all of the HF that was generated entered the occupied space and if occupants remained for the entire 8 hour work period. Using the range of emission rates described above (0.027 μg HF/ml to 0.13 μg HF/ml of solution) air concentrations of $5.7\times10^{-5}$ mg/m$^3$ to $2.7\times10^{-4}$ mg/m$^3$ were estimated. Assuming a normal respiration rate of 0.833 m$^3$/hour and 100% absorption of fluoride in the lungs, the potential dose ranges from 0.38 μg/8-hour workday to 1.8 μg/8-hour workday. This amount of inhaled fluoride is approximately 14,000 times less than the amount inhaled by a worker exposed to the PEL and 3,000 times less than the amount of fluoride ingested daily by most Americans from food and water.

Based upon the comparison of acute exposures with those that are considered safe no acute adverse health effects should be expected from the proper and intended use of the product. Based upon the comparison of the daily dose of HF and the normal daily intake no chronic adverse health effects should be expected from the proper and intended use of the product of the present invention.

Methods and Materials

Test Chamber Construction

The test chamber was constructed of stainless steel, with an internal volume of 20.45 Liter. The volume of all components inside the chamber was determined to be 0.45 L, resulting in a total air volume inside the chamber of 20.0 L. A plastic drain pan, circulating fan and a cooling coil section measuring 15 cm×15 cm×7.6 cm were placed inside the chamber. A new section of coil was used for each test run to avoid residue carryover from run to run.

Test Sample Application

Coil cleaning solutions and rinse water were applied from containers outside the chamber via spray nozzles placed above the coil. It was experimentally determined that 200 ml of fluid was delivered in 30 seconds and 400 ml was delivered in 60 seconds. The time of application was used to ensure the same amount of fluid was applied during each test run.

Chamber Ventilation

Ventilation air was filtered through a glass fiber filter, without binder, in a 37 mm filter cassette. Continuous chamber ventilation was provided by drawing air from the chamber with a personal sampling pump (Alpha-1 Portable Air Sampling Pump). An in-line airflow calibrator, BIOS DryCal™, was utilized during each test run to measure the flow rates. Beginning and ending flow rates were averaged to determine a mean flow rate. The BIOS DryCal™ calibrator was factory calibrated prior to testing. Additional chamber ventilation was due to sample collection when 2.0 L of chamber air was drawn through the sample port collection device.

Air exchange rates for each test run were determined by measurement of continuous flow rates during sampling. Mean air exchange rates were ~2.2 air changes per hour (ACH) or 0.735 liter per minute (lpm). The air exchange rate of the chamber was determined during separate test runs using sulfurhexafluoride ($SF_6$) tracer gas. The concentration of $SF_6$ was monitored using a Foxboro Miran 203 Specific Vapor Analyzer with a measurement range of 0-2500 ppm. The reported accuracy was ±<1% of full scale. Equation 1 was used to calculate the chamber air exchange rate.

Equation 1

$$I = \frac{\ln C(t_1) - \ln C(t_2)}{t_2 - t_1}$$

where

I=Air Exchange Rate lnC(t)=Natural Log of the Concentration of Tracer Gas at Time t.

Chamber Mixing

A circulating fan was installed in the chamber to ensure thorough mixing. The chamber mixing level was determined during separate test runs using sulfurhexafluoride ($SF_6$) tracer gas. The concentration of $SF_6$ was monitored using a Foxboro Miran 203 Specific Vapor Analyzer with a measurement range of 0–2500 ppm. The reported accuracy was ±<1% of full scale. Equation 2 was used to calculate the chamber mixing level.

To determine the chamber mixing level guidance provided in section 5.2.2.2 of the *ASTM Standard Guide for Small-Scale Environmental Chamber Determinations of Organic Emissions From Indoor Materials/Products D*5116-97 was used. "If the mixing level η, is greater than 80%, then air mixing within the chamber can be considered adequate." Mixing level within this chamber was determined to be 95%.

Equation 2

$$\eta = \left\{1 - \frac{\sum_{i=1}^{n} [|C_A(t_i) - C(t_i)|(t_i - t_i - 1)]}{\sum_{i=1}^{n} [C(t_i)(t_i - t_i - 1)]}\right\} \times 100\%$$

where

η=mixing level

N=chamber air exchange rate in units of inverse time $t_n$=time constant of chamber=N-$^{-1}$ $C_m(t_i)$=tracer gas concentration in chamber exhaust $C(t_i)$=concentration for perfectly mixed system, calculated by $C(t)=C_{oe}^{-Nt}$ n=number of discrete concentration measurements $t_i$=time of $i^{th}$ concentration measurement $C_o$=tracer gas concentration at t=0

Environmental Conditions

Due to the potential for damage to temperature and humidity measurement probes inside the chamber, only the air entering the chamber was measured. Temperature and relative humidity were measured using a Metrosonics™ AQ 501 air quality monitor. For temperature measurement the Metrosonics™ AQ-501 air quality monitor used a resistance temperature detection (RTD) sensor with a range of 0° to +60° C. and an accuracy of ±/0.25° C. with a resolution of 0.1° F. To measure relative humidity a capacitive sensor was used with an accuracy of ±/3% at 25° C. and a resolution of 0.1%.

Sample Collection and Measurement

Sample collection was by Draeger Accuro™ Pump. The Accuro™ is a bellows type pump, which provides one-hand operation. An internal mechanism ensures a uniform, even pump stroke delivering 100 cubic centimeters (cm$^3$) of sample air per stroke. HF detection was accomplished by the use of Draeger™ Tube CH 30301, requiring 20 pump strokes, or 2 L. Tubes contain a light-blue indicating layer that changes color to a light pink in the presence of HF. The principal of the reaction is based on the following reaction:

$$HF+Zr(OH)_4/\text{chinalizarine} \rightarrow [ZrF_6]^2+\text{chinalizarine}$$

The measurement range of the Draeger™ Tube CH 30301 is from 1.5 to 15 ppm at temperatures ranging from 59° F. (15° C.) to 86° F. (30° C.). The relative standard deviation for the detector tube was reported by the manufacturer as ±15% to 20%. The use and measurement of detector tubes to detect and measure toxic gases is described in *ASTM d* 4490-90 *Standard Practice for Measuring the Concentration of Toxic Gases or Vapors Using Detector Tubes.*

Maximum humidity for reliable measurements is 50% at 68° F. (20° C.). At humidity above 50% HF mists can form that cannot be quantitatively measured by this tube and may result in false low readings. Relative humidity measurements during chamber runs were below 50%. Cross sensitivities with other hydrogen halides are not indicated under the test conditions. All test tubes were new and had not expired at the time of testing. No corrections for pressure were applied since all measurements were taken at approximately sea level.

Determination of Vapor to Aqueous Ratio

In order to estimate the amount of HF emitted from a solution containing HF, a standard solution was developed which contained 6.1% free HF. A "Vapor to Aqueous Ratio" was experimentally derived for the mass of HF emitted into the air of the chamber in relation to the mass of free HF in the solution. It was determined that approximately 8.2 $\mu$g of HF was emitted into the air per gram of free HF in solution. This ratio was used to predict the total emissions of another commercially available HF-containing coil cleaner (HF coil cleaner). This cleaner was chosen because it is known to contain HF and is widely available. Chemical analysis of the HF coil cleaner revealed it contained 3.6% free HF.

The Vapor to Aqueous ratio was determined using the stainless-steel chamber described above. The air exchange rate was diminished to ensure that the chamber had reached equilibrium. Because 2 L of chamber air was evacuated during sample collection the air exchange rate was 0.1 ACH. A total of five samples were collected. One sample was collected after one, two, four, six and eight hours, with each sample resulting in an air concentration of 3 ppm. It was determined that 50 $\mu$g of vaporous HF was emitted from 6.1 g of free HF in the standard solution. The temperature remained at 75° F. (24° C.) and relative humidity was 44%.

Two chamber test runs were conducted using the HF coil cleaner to determine the mass of HF emitted into the air of the chamber. Results of the tests performed on the HF coil cleaner and on the standard solution agreed within 12% of the predicted value, indicating that the test procedure was capable of accurately measuring HF emission from solutions in the chamber.

Experimental Design

Critical Parameters

- Chamber volume: 20 liters
- Air Exchange Rate ~2.2 ACH (mean 0.735 lpm), but recorded for each test run
- Temperature monitored, but not controlled. Ranged from 74°–77° F. (23°–25° C.)
- Relative humidity monitored, but not controlled. Ranged from 42%-46% RH
- Product Volume was 200 ml (30 second application) onto a 15 cm×15 cn×7.6 cm coil
- Washing Volume was 400 ml (60 second application)
- All material not retained in the coil was drained from the catch pan, out of the chamber
- Drain line had a water seal preventing air transport into or out of the chamber.

Sample Description

All test samples were from use dilutions of coil cleaner that were mixed immediately before testing.

- Standard Solution: 28.1 g of Ammonium Biflouride in 100 ml of deionized water. Contained 6.1% free HF, or 6.1 g of free HF. 100 ml of standard solution was placed on a plastic container inside the chamber, without the coil present (Chamber Volume=20.45 L).
- HF coil cleaner: A "use dilution" (in tap water) containing 3.6% free HF, or 7.2 g of free HF. 200 ml of HF coil cleaner was applied for each test run onto the coil (Chamber Volume=20 L). Use dilution was mixed in accordance with label directions. 1:3.
- Formulation of Example J: Use dilution (in tap water) containing 0.33% free HF, or 0.66 g of free HF. 200 ml of the formulation of Example J was applied onto the coil for each test run (Chamber Volume=20 L). A "use dilution" was mixed with tap water at a dilution rate of 1:3.

Experimental Procedures

Determination of Vapor to Aqueous Ratio

- Chamber was cleaned, dried and assembled
- Water seal on drain line was filled
- Inlet air filter was attached
- Standard Solution (100 ml) was placed in center of chamber
- Circulating fan was inserted and electrically wired
- Chamber access port was closed and sealed
- Chamber was allowed to equilibrate for 1 hour under static conditions (0.1 ACH). A low air exchange rate was used to ensure the chamber had come to equilibrium
- Draeger™ tube was attached to the sampling port
- Circulating fan was turned off during sampling
- Twenty pump strokes (100 $cm^3$ each) were drawn through the Draeger™ Tube
- Circulating fan was turned on
- Subsequent samples taken at 2, 4, 6 and 8 hours into test run. Samples were collected in the same manner as above
- Sample tubes were visually read and results recorded Testing of HF Emissions from HF and Example J

- Chamber was cleaned, dried and assembled
- Water seal on drain line was filled
- Inlet air filter was attached
- Continuous exhaust pump was attached and set to 0.333 lpm using the BIO DryCal™
- A new dirty test coil was placed in the chamber over the drain pan and below the spray nozzle
- Circulating fan was inserted and electrically wired
- Chamber access port was closed and sealed
- Circulating fan was turned on
- Test solution container was attached to the spray nozzle
- Circulating fan was allowed to run for 5 minutes and a background sample was taken
  - Draeger™ tube was attached to the sampling port
  - Circulating fan was turned off during sampling
  - Twenty pump strokes (100 $cm^3$ each) were drawn through the Draeger™ Tube
  - Sample tubes were visually read and results recorded
- Test solution was applied for 30 seconds (200 ml) through the spray nozzle Circulating fan was turned on Test solution container was detached from the spray nozzle and the wash water container was attached to the spray nozzle. The chamber was not opened during this process Coil cleaner was allowed 4 minutes residence time on the coils and sample 1 was begun Circulating fan was turned off during sample collection Sample collection took 2 minutes. Sample 1 identified as "5 minute" sample Circulating fan was turned on Sample tube was visually read and results recorded Circulating fan was allowed to run for 4 minutes and sample 2 was taken Draeger™ tube was attached to the sampling port Circulating fan was turned off during sampling Twenty pump strokes (100 $cm^3$ each) were drawn through the Draeger™ Tube Sample collection took 2 minutes. Sample 2 identified as "10 minute" sample Sample tube was visually read and results recorded Wash water was applied through spray nozzle for 60 seconds (400 ml)

Circulating fan was turned on

Chamber was allowed to run for 5 minutes and a post-washing sample was taken

Draeger™ tube was attached to the sampling port

Circulating fan was turned off during sampling

Twenty pump strokes (100 $cm^3$ each) were drawn through the Draeger™ Tube

END CHAMBER TEST

Open Chamber access port

Disconnect and remove fan

Remove coil and drain remaining liquid in pan

Wipe internal chamber surfaces of all droplets and residue

Prepare for nest test run.

Specimen Preparation of HF and Composition of Example J

Mix "use dilution" (1:3) as per instructions into a 2 gallon pressure spray applicator Pressurize sprayer with 30 full stroke pumps Experimental determination of volume delivery was performed and all three applicators delivered 6.66 ml/sec, which equated to 200 ml in 30 seconds and 400 ml in 60 seconds.

Draeger™ Tube Measurements

Instructions for the use and reading of Draeger™ Tubes CH 30301 for Hydrogen Fluoride were followed. (See attached label instructions)

Tubes were read by at least two individuals.

Data Analysis

The total mass of HF emitted during each 10 minute test run was determined using Equation 3. The sample taken after the coils were washed was to assess the possibility of continued HF generation from residue. All post-wash samples were significantly lower than samples taken during coil cleaning, indicating that HF generation had ceased.

Equation 3

$$W_E = W_{a,t} + W_X$$

where $W_E$=Total mass emitted by the source during the test period 0 to t, $W_{a,t}$=Total mass in the chamber at the end of the test, $W_A$=Total mass leaving the chamber through the air exchange flow.

Equation 3.1

$$W_{a,t} = C_{a,t} V$$

where $C_{a,t}$=Chamber concentration at time t ($mg/m^3$)

V=Chamber Volume

Equation 3.2

$$Sc = \Sigma[(C_i + C_{i+1})t_{i+1} - t_i)/2](i=0,1,2)$$

Equation 3.3

$$W_x = S_C Q$$

where

Q=Chamber Flow Rate

TABLE B

| | Test Results | |
|---|---|---|
| | Test Runs for HF coil cleaner | Test Runs for Example J |
| Mass of HF emitted per Volume of Solution | 0.26 μg/ml solution | <0.13 μg/ml solution 1)<br>0.027 μg/ml solution 2) |
| Predicted Value of total mass of HF emitted based on measured amount of free HF in solution | 59 μg HF | 5.4 μg HF 2) |
| Total mass of HF emitted by the source during the test period: $W_E$ | 52 μg HF | <25.7 μg HF 1) |
| Total mass of HF in the Chamber at the end of the test: $W_{a,t}$ | 41 μg HF | <24.6 μg HF 1) |
| Total mass of HF leaving the chamber through the air exchange flow: $W_x$ | 11 μg HF | <1.1 μg HF 1) |
| Volume of Solution Tested | 200 ml | 200 ml |
| μg free HF in Solution | 7.2 μg | 0.66 μg |
| Number of Replicate Test Runs | 2 Test Runs | 3 Test Runs 3) |
| Temperature | 77° F. (25° C.) | 75° F. (24° C.) |
| Relative Humidity | 44% | 45% |

TABLE B-continued

| | Test Results | |
|---|---|---|
| | Test Runs for HF coil cleaner | Test Runs for Example J |
| Air Exchange Rate | 2.23 ACH | 2.18 ACH |
| Air Flow Rate | 0.743 lpm | 0.728 lpm |

1) Values represent the minimum detection limit of HF for the analytical method
2) Values represent predicted value based on calculation and experimentally derived constants
3) A third test run was conducted to verify findings because no HF was detected in the two scheduled runs Discussion and Conclusion The test results for the composition of Example J indicate that if any HF is emitted into the air, it is below the quantification limit of 0.13 μg/ml solution. The quantification limit of the Tube was 1.5 ppm, or 24.6 μg HF in the air of the chamber. HF emissions were below the detection limit of the testing system used. Because emissions were below the detection limit, it cannot be assumed they were not present at all. A conservative approach is to assume HF emissions may be as high as the detection limit of the method used to test the product. This approach was used in estemating the upper bound of HF concentrations that may be generated by this product. A closer estimation of the actual HF emissions may be obtained by using the experimentally derived Vapor to Aqueous Ratio (8.2 μg $HF_{Air}$/g $HF_{Solution}$) and the measured amount of free HF in the Example J solution (0.66 g HF). An estimated value of 0.027 μg HF/ml solution was calculated. This value is approximately 5 times lower than the lower detection limit of the analytical method and approximately 10 times lower than the emission rate measured for the competitive coil cleaner.

Using the 20 L stainless steel chamber, described above, initial estimates of HF emissions from coil cleaners containing HF were obtained without exposing human subjects to potentially hazardous HF. The experimentally derived Vapor to Aqueous Ratio of 8.2 μg $HF_{Air}$/g $HF_{Solution}$ was within 12% of that observed in the HF coil cleaner of 7.2 μg $HF_{Air}$/g. Numberous factors may have contributed to the observed difference such as variations in the percent of free HF in the HF coil cleaner, errors in measuring HF or loss of HF to internal chamber surfaces.

A longer chamber test would have allowed for more sample data points, but the intention of this test was to simulate the maximum time that a coil cleaner would remain on a coil during cleaning. To prevent damage to coil surfaces it is not recommended to leave coil cleaners in contact with coils for longer than 5 minutes. The chamber test was performed using a ten-minute coil residence time, which would to be a worst-case condition. Due to the time necessary to collect a sample, no more than 2 samples could be taken during the 10-minute test.

The ratio of HF emission to volume of cleaning solution was then used to estimate potential air concentrations of HF resulting from the use of the tested products. For comparison purposes, the HF emissions and possible exposures to workers were estimated for a residential coil and commercial coil application. These air concentrations are based on several assumptions outlined below.

Residential Application

A typical residential coil measures 2'×2'×3" and requires 400 ml of cleaning solution for proper coverage. The coil cleaner is assumed to stay on the coils for 10 minutes, a worst-case scenario, because directions limit it to 5 minutes. The volume of air inside the air handling unit compartment is assumed to be 0.125 $m^3$ (0.5 m×0.5 m×0.5 m). The HF coil cleaner may be expected to produce an air concentration of 1.1 ppm HF. Based upon the lower limit of detection of this analytical method, air concentration of HF will be less than 0.58 ppm. Using the predicted value, the composition of the present invention would be expected to generate an air concentration of 0.1 ppm.

Commercial Application

A typical commercial coil can measure 4'×6'6" and requires 4,800 ml of cleaning solution for proper coverage. The coil cleaner is assumed to stay on the coils for 10 minutes, a worst-case scenario, because directions limit it to 5 minutes. The volume of air inside the air handling unit compartment is assumed to be 1.0 $m^3$ (1.2 m×2 m×0.4 m). The HF coil cleaner may be expected to produce an air concentration of 1.5 ppm HF. Based upon the lower limit of detection of this analytical method, air concentration of HF will be less than 0.76 ppm. Using the predicted value, the formulation of Example J would be exptected to generate an air concentration of 0.158 ppm.

To determine release of HF, a 20-liter stainless steel chamber was used to measure HF concentrations generated during simulated coil cleaning. The chamber was determined to be capable of accurately detecting and quantifying HF emissions from other solutions that emitted HF. As can be seen from the following results, the C composition of the present invention resulted in no measurable emissions of HF during the ten minute test. Chamber tests were used to estimate HF air concentrations that might be generated from product use in residential and commercial applications. Predicted HF air concentrations from using the compositions of the present invention were below the level that is determined to cause acute health effects.

A study was conducted to determine the percentage of "total" and "free" HF contained in a composition according to the present invention, a widely available coil cleaner called Acti-Brite manufactured by Virginia KMP Corporation of Dallas Tex., the active ingredients of which are hydrogen fluoride and phosphoric acid, and a 4% ammonium bifluoride solution using a titration method supplied by Solvay Fluorides, Inc.

Procedure

Initially 50 ml of a Calcium chloride ($CaCl_2$) solution was placed in each of the six 500 ml beakers. 1.2 ml of concentrate of Example J; Example J (1:3) dilute; Acti-Brite concentrate; Acti-Brite (1:3) dilute; 4% ABF Solution concentrate; 4% ABF Solution (1:3) dilute were individually added to each beaker containing the solution, followed by 3–5 drops of methyl red. The solutions were then neutralized by slowly adding NaOH, until a yellow color appeared. The exact amount of sodium hydroxide (NaOH) required was recorded as the $1^{st}$ Consumption. These solutions were added to 45 ml of a formalin solution, and was allowed to mix throughly. After the mixing was complete, 3-5 drops phenolphthalein were added, NaOH was then used to titrate until a rose color appeared. The amount NaOH needed was recorded as the $2^{nd}$ Consumption.

Results

The percentages were derived from equations supplied by Solvay Fluorides, using the consumption values gained during the titration.

$$\text{Total HF} = \frac{(\text{ml } 1^{st} \text{ Consumption} + \text{ml } 2^{nd} \text{ Consumption}) \times 2}{\text{Exact sample weight (g)}}$$

$$\text{Free HF} = \frac{(\text{ml } 1^{st} \text{ Consumption} - \text{ml } 2^{nd} \text{ Consumption}) \times 2}{\text{Exact sample weight (g)}}$$

Concentrate

| PRODUCT NAME | (%) TOTAL HF | (%) FREE HF |
|---|---|---|
| Present Invention (4% ABF) | 3.3% | 0.66% |
| ACTI-BRITE (unknown) | 12.2% | 8.8% |
| % ABF SOLUTION (4% ABF) | 3.66% | 2.00% |

Dilution (1:3)

| PRODUCT NAME | (%) TOTAL HF | (%) FREE HF |
|---|---|---|
| Present Invention | 1.00% | 0.33% |
| ACTI-BRITE | 5.0% | 3.6% |
| % ABF SOLUTION | 1.33% | 0.66% |

Discussion

From the results above, we calculated the total amount of HF available, and of that total amount of HF what percentage is free (available for release). The Acti-Brite concentrate has total HF content of 12.2%, and the amount of free HF is 8.8%. The diluted formula contained 5.0% total HF and 3.6% free HF, which means that 4–8% of the cleaners formula contains "free" HF which is released during the application and used of this product. The concentrate of the present invention contains 3.3% total HF which is 75% less than Acti-Brite's total HF value, and 0.66% free HF, which is 93% less than Acti-Brite's Free HF. Results from a related study, measuring the HF content in air, shows that at the same levels utilized in this study, Acti-Brite measured well above the Threshold Limit Value (TLV) of 3 ppm (parts-per-million), whereas the composition of the present invention was found to be Below the Detection Limit (BDL) of 0.5 ppm.

Conclusion

Of all of the tested products, there is evidence that the compositions of the present invention showed the lowest release of free HF. Acti-Brite, which is very harsh on aluminum surfaces, contained very high levels of HF, which could account for its offensive odor and metal degradation. The 4% ABF solution proves that even though the ABF (%) content is identical to that of the compositions of the present invention, the composition of the present invention inhibits the release of HF, while maintaining product efficacy.

Procedure

A group of Sprague-Dawley derived, albino rats was received from Davidson's Mill Farm, South Brunswick, N.J. The animals were singly housed in suspended stainless steel caging with mesh floors. Litter paper was placed beneath the cages and was changed at least three times per week. The animal room was temperature controlled and had a 12-hour light/dark cycle. The animals were fed Purina Rodent Chow #5012 and filtered tap water was supplied ad libitum by an automatic watering system.

Following acclimation to the laboratory, a group of animals was prepared by clipping (Ostermodel #A5-small) the dorsal area of each animals' trunk free of hair. Ten rats (five male and five female), without pre-existing dermal irritation, were selected for test based on health and initial bodyweights. One test site, approximately 2 inches×2 inches, was delineated on each animal.

Two thousand mg/kg of bodyweight of the test substances was applied evenly over a dose area of approximately 2 inches×3 inches (approximately 10% of the body surface) and covered with a 2 inch×3 inch, 4-ply gauze pad. The pad and entire trunk of each animal were then wrapped with 3 inch Durapore tape to minimize loss of the test substance and to avoid dislocation of the patches. The rats were then returned to their designated cages. After 24 hours of exposure, the patches were removed and the test sites gently wiped with water and a clean towel to remove any residual test substance.

The animals were observed for mortality, signs of gross toxicity and behavioral changes at least once daily for 14 days. Body weights were recorded prior to initiation and at termination. All rats were euthanized via $CO_2$ inhalation and termination.

Results

Individual body weight and doses are presented in Table C1. Individual cage-side observations are presented in Table C2.

TABLE C1

INDIVIDUAL BODY WEIGHTS AND DOSES

| | | Body weight (g) | | Dose[1] |
|---|---|---|---|---|
| Animal No. | Sex | Initial | Day 14 | ml |
| 4910 | M | 236 | 340 | 0.47 |
| 4911 | M | 261 | 368 | 0.52 |
| 4912 | M | 250 | 318 | 0.50 |
| 4913 | M | 262 | 358 | 0.52 |
| 4914 | M | 243 | 317 | 0.49 |
| 4915 | F | 187 | 232 | 0.37 |
| 4916 | F | 169 | 202 | 0.34 |
| 4917 | F | 180 | 211 | 0.36 |
| 4918 | F | 180 | 210 | 0.36 |
| 4919 | F | 184 | 225 | 0.37 |

[1]Administered as received Specific Gravity - 1.001 g/ml.

TABLE C2

INDIVIDUAL CAGE-SIDE OBSERVATIONS

| Animal Number | Findings | Day of Occurrence |
|---|---|---|
| MALES | | |
| 4910 | Hypoactive | 0 (1 hr)–1 |
| | Active and Healthy | 2–14 |
| | Erythema/Edema present at dose site | 1–4 |
| | Dark brown discoloration noted at site | 3–4 |
| | Eschar present at dose site | 5 |

TABLE C2-continued

INDIVIDUAL CAGE-SIDE OBSERVATIONS

| Animal Number | Findings | Day of Occurrence |
|---|---|---|
| 4911 | Active and healthy | 0 (1 hr)–14 |
| | Erythema/Edema present at dose site | 1–4 |
| | Dark brown discoloration noted at site | 3–4 |
| | Eschar present at dose site | 5–6 |
| 4912, 4913 | Active and healthy | 0 (1 hr)–14 |
| | Erythema/Edema present at dose site | 1–4 |
| | Dark brown discoloration noted at site | 4 |
| | Eschar present at dose site | 5–11 |
| 4914 | Active and healthy | 0 (1 hr)–14 |
| | Erythema/Edema present at dose site | 1–4 |
| | Dark brown discoloration noted at site | 3–4 |
| | Eschar present at dose site | 5 |
| FEMALES | | |
| 4915 | Active and healthy | 0 (1 hr)–14 |
| | Erythema/Edema present at dose site | 1–4 |
| | Dark brown discoloration noted at site | 4 |
| | Eschar present at dose site | 5–12 |
| 4916 | Active and healthy | 0 (1 hr)–14 |
| | Erythema/Edema present at dose site | 1–4 |
| | Dark brown discoloration noted at site | 4 |
| | Eschar present at dose site | 5–13 |
| 4917 | Active and healthy | 0 (1 hr)–14 |
| | Erythema/Edena present at dose site | 1–4 |
| 4918, 4919 | Active and healthy | 0 (1 hr)–14 |
| | Erythema/Edema present at dose site | 1–5 |
| | Eschar present at dose site | 6-11 |

All animals survived and gained body weight during the study. With the exception of hypoactivity noted in one rat from one hour to Day 1, all animals appeared active and healthy over the 14-day observation period. There were no signs of gross toxicity, adverse pharmacologic effects or abnormal behavior. Dark brown discoloration and/or dermal irritation (erythema, edema and eschar) were observed at all dose sites between Days 1 and 13.

Conclusion

The single dose acute dermal $LD_{50}$ of a composition of Example J is greater than 2,00 mg/kg of body weight.

Ammonium bifluoride as an ingredient in cleaning compositions has the disadvantage of possibly generating hydrofluoric acid (HF). Existing literature suggests that use of ammonium bifluoride as an ingredient in cleaning composition will lead to the release of significant quantities of HF. However, compositions of the present invention were found to generate minimal HF, despite the presence of ammonium bifluoride in the compositions.

To provide information on health hazards likely to arise from a short-term continuous exposure (about one hour) to the compositions according to the present invention by the inhalation route, a test was conducted as follows:

Procedure

A group of Sprague-Dawley derived, albino rats was received from Ace Animals, Inc., Boyertown, Pa. The animals were singly housed in suspended stainless steel caging with mesh floors. Litter paper was placed beneath the cages and was changed at least three times per week. The animal room was temperature controlled and had a 12-hour light/dark cycle. The animals were fed Purina Rodent Chow #5012 and filtered tap water was supplied ad libitum by an automatic water dispensing system except during exposure.

Ten healthy rats (five males and five females) were selected for test and exposed to the test atmosphere for 1 hour. Chamber concentration and particle size distribution of the test substance was determined periodically during the exposure period. The animals were observed for mortality, signs of gross toxicity and behavioral changes at least once daily for 14 days. Body weights were recorded prior to exposure again on Day 14 (termination) or after death. Surviving animals were euthanized by $CO_2$ inhalation and termination. A gross necropsy was performed on all decedents as soon as possible after death.

Inhalation Procedures

A. Exposure Chamber

Rectangular whole body Plexiglas chamber with a volume of 100 liters, with pre-chamber operated under slight negative pressure.

B. Air Supply

Approximately 20.0 liters per minute (Lpm) of filtered air was supplied by an air compressor (JUN-AIR) to the spray atomization nozzle. Aproximately 20.1 Lpm of filtered conditioned room air was supplied as diluent air.

C. Atmosphere Generation

The test atmosphere was generated using a ¼ inch JCO atomizer, FC4 fluid cap and AC1502 air cap (Spraying Systems, Inc.). Compressed air was supplied at 25 psi. The test substances metered to the atomization nozzle through Size 14 Master Flex Tygon tubing, using a Master Flex Pump Model 7520-35.

D. Ambient Conditions

The room temperature and relative humidity ranges during exposure were 21° C. and 58–60% RH, respectively. The temperature and relative humidity ranges within the exposure chamber during the test were 21–22° C. and 58–100% RH, respectively. Room conditions were measured with a Dickson Temperature-Humidity Monitor Model TH550 and in-chamber measurements were made with a Taylor Humidity Temperature Indicator 5502.

E. Nominal Chamber Concentration Measurements

The aerosolization of the test substance and total airflow into the chamber were carefully monitored during exposure. The nominal concentration is defined as follows:

$$\text{Nominal Concentration} = \frac{\text{Total Test Substance Used}}{\text{Average Airflow} \times \text{Total time}}$$

Prior to the initiation of the study, trials were conducted to determine the prior equipment and setting needed to attain the targeted exposure concentration.

F. Gravimetric Chamber Concentration Measurements

Gravimetric samples were withdrawn on two occasions from the breathing zone of the animals. Samples were collected using 25 mm glass fiber filter (GF/B Whatman) in a filter holder attached by ¼ inch tygon tubing to an Emerson Electric vacuum pump Model #S55NXMLD-6711. Filter papers were weighted before and after collection to determine the mass collected. This value was divided by the total volume of air sampled to determine the chamber concentration. The collections were carried out for 1 minute at airflows of 4 Lpm.

G. Particle Size Distribution

An eight-stage Andersen cascade impactor was used to assess the particle size distribution of the test atmosphere. A sample was withdrawn from the breathing zone of the animals. The filter paper collection stages were weighed before and after sampling to determine the mass collected at each stage. The aerodynamic mass median diameter and geometric standard deviation were determined graphically using two-cycle logarithmic probit axes.

H. Exposure Period

The animals were exposed to the test atmosphere for 1 hour and 12 minutes. The exposure period was extended beyond 1 hour to allow the chamber to reach equilibrium ($T_{99}$). The times for 90 and 99% equilibration of the atmosphere were 5.7 and 11.5 minute, respectively. At the end of the exposure period, the generation was terminated and the chamber was operated for a further 15 minutes with clean air. At the end of this period the animals were removed from the chamber. Prior to being returned to their cages, excess test substance was removed from the fur of each animal.

Results

Nominal and gravimetric chamber concentrations are shown in Table D1. Particle size sampling results are presented in Table D2. Individual body weights, dosage and mortalities are presented in Table D3. Cage-side and necropsy observations are shown in Tables D4 and D5.

TABLE D1

NOMINAL CHAMBER CONCENTRATION

| Target Exposure Level (mg/L) | Total Test Substance Used (g) | Average Total Airflow (Lpm) | Total Time of Exposure (min) | Nominal Concentration[2] (mg/L) |
|---|---|---|---|---|
| 200.0 | 581.2 | 40.1 | 72 | 201.3 |

GRAVIMETRIC CHAMBER CONCENTRATIONS

| Sample Number | Time of Sampling (hour) | Mass Collected (mg) | Airflow Sampled (Lpm) | Collect-ion Time Time (min | Chamber Concentration (mg/L) |
|---|---|---|---|---|---|
| 1 | 0.5 | 31.8 | 4 | 1 | 7.95 |
| 2 | 1 | 34.6 | 4 | 1 | 8.65 |
| | | | Average ± Standard Deviation | | 8.30 ± 0.49 |

$$^{2}\text{Nominal Concentration (mg/L)} = \frac{\text{Total Test Substance Used (mg)}}{\text{Average Airflow (Lpm)} \times \text{Total Time (Min)}}$$

TABLE D2

PARTICLE SIZE DISTRIBUTION

| Stage | Effective Cutoff Diameter (μm) | % Total Particles Captured (by weight) | Cumulative (%)[3] |
|---|---|---|---|
| 0 | 9.0 | 4.1 | 95.9 |
| 1 | 5.8 | 12.7 | 83.3 |
| 2 | 4.7 | 10.6 | 72.7 |
| 3 | 3.3 | 26.1 | 46.6 |
| 4 | 2.1 | 25.8 | 20.8 |
| 5 | 1.1 | 15.9 | 4.8 |
| 6 | 0.7 | 3.8 | 1.1 |
| 7 | 0.4 | 0.8 | 0.3 |
| F | 0.0 | 0.3 | 0.0 |

SUMMARY OF PARTICLE SIZE DISTRIBUTION

| Time of Sample (hour) | Collection Time (minutes) | Mass Median Aerodynamics (μm) | Geometric Standard Deviation |
|---|---|---|---|
| 0.75 | 1 | 3.4 | 1.97 |

TABLE D3

INDIVIDUAL BODY WEIGHTS AND MORTALITY

| | | Body weight (g) | | Mortality | |
|---|---|---|---|---|---|
| Animal No. | Sex | Initial | Day 14 | Day | Weight |
| 5100 | M | 279 | 376 | E | — |
| 5101 | M | 270 | 354 | E | — |
| 5102 | M | 282 | 372 | E | — |
| 5103 | M | 286 | — | 0 | 278 |
| 5104 | F | 267 | 370 | E | — |
| 5105 | F | 200 | 222 | E | — |
| 5106 | F | 225 | 265 | E | — |
| 5107 | F | 185 | 219 | E | — |
| 5108 | F | 201 | 237 | E | — |
| 5109 | F | 200 | — | 0 | 195 |

E - Euthanized via $CO_2$ inhalation after weighing on Day 14

[3]Percent of particles smaller than corresponding effective cutoff diameter.

TABLE D4

INDIVIDUAL CAGE-SIDE OBSERVATIONS

| Animal Number | Findings | Day of Occurrence |
|---|---|---|
| MALES | | |
| 5100 | Irregular respiration | CR[4] |
| | Hunched posture, hypoactive | CR–0 (1 hr) |
| | Active and Healthy | 0 (20 hr)–14 |
| 5101 | Hunched posture, hypoactive | CR–1 |
| | Irregular respiration | CR–2 |
| | Dyspnea | 0 (20 hr)–1 |
| | Rales (moist), reduced fecal volume | 0 (20 hr)–2 |
| | Active and Healthy | 3–14 |
| 5102 | Hunched posture | CR–1 |
| | Hypoactive | CR–6 |
| | Irregular respiration | 0 (1 hr)–6 |
| | Dyspnea | 0 (20 hr)–1 |
| | Reduced fecal volume | 0 (20 hr)–2 |
| | Rales (dry) | 0 (20 hr)–3 |
| | Active and healthy | 7–14 |
| 5103 | Hunched posture | CR |
| | Irregular respiration, dyspnea, hypoactive | CR–0 (1 hr) |
| | Prone | 0 (1 hr) |
| | Dead | 0 (1.5 hr) |
| 5104 | Hunched posture | CR–0 (1 hr) |
| | Hypoactive | CR–2 |
| | Ocular discharge (red) | 0 (20 hr)–2 |
| | Active and healthy | 3–14 |
| FEMALES | | |
| 5105 | Irregular respiration, hunched posture | CR[5] –1 |
| | Hypoactive | CR–2 |
| | Active and Healthy | 3–14 |
| 5106 | Hypoactive | CR–2 |
| | Ocular discharge (red) | 0 (20 hr)–2 |
| | Active and Healthy | 3–14 |
| 5107 | Hunched posture, hypoactive | CR–1 |
| | Ocular discharge (red) | 0 (20 hr)–2 |
| | Active and healthy | 3–14 |
| 5108 | Hunched posture | CR–0 (1 hr) |
| | Hypoactive | CR–1 |
| | Ocular discharge (red) | 0 (20 hr)–2 |
| | Active and healthy | 3–14 |
| 5109 | Hunched posture | CR |
| | Irregular respiration, dyspnea, hypoactive, corneal opacity (both eyes) | CR–0 (1 hr) |
| | Prone | 0 (1 hr) |
| | Dead | 0 (1.5 hr) |

[4]CR - removal from exposure chamber

[5]CR - removal from exposure chamber

TABLE D5

| INDIVIDUAL NECROPSY OBSERVATIONS | | |
|---|---|---|
| Animal Number | Tissue | Findings |
| MALE | | |
| 5103 | Lungs | Slightly red, extreme edematous |
| | Intestines | Extremely red |
| FEMALE | | |
| 5109 | Lungs | Slightly red, extreme edematous |
| | Intestines | Extremely red |

One male and one female died as a result of exposure to the test atmosphere. The nominal chamber concentration was 201.3 mg/L. The mass median aerodynamic diameter was estimated to be 3.4 microns based on the particle size distribution as measured with an Anderson Cascade Impactor.

In-chamber animal observations included ocular and nasal discharge, irregular respiration, hunched posture and hypoactivity. Similar clinical signs persisted in all rats upon removal from the exposure chamber. In addition, several animals developed dyspnea, rales and/or a reduced fecal volume. Corneal opacity and/or a prone posture were also noted in the two decedents prior to death. All surviving rats recovered from the above symptoms by Day 7 and appeared active and healthy for the remainder of the study, gaining body weight over the 14-day observation period. Gross necropsy of the decedents revealed discoloration of the lungs and intestines and edema of the lungs.

Conclusion

Under the conditions of this study, the acute inhalation $LC_{50}$ of the aqueous coil cleaner of the present invention is greater than 201.3 mg/L (nominal).

To provide information on health hazards likely to arise from ingestion of compositions of the present invention, studies were conducted as follows:

Procedure

A group of Sprague-Dawley derived, albino rats was received from Ace Animals, Inc., Boyertown, Pa. The animals were singly housed in suspended stainless steel caging with mesh floor. Litter paper was placed beneath the cages and was changed at least three times per week. The animal room was temperature controlled and had a 12-hour light/dark cycle. The animals were fed Purina Rodent Chow #5012 and filtered tap water was supplied ad libitum by an automatic watering system.

Following acclimation to the laboratory, 30 healthy rats were selected for test and equally distributed into three dose groups of five males and five females each. Dose levels of 500, 1,500 and 5,000 mg/kg were selected for testing. Prior to dosing, each group of animals was fasted for approximately 20–23 hours by removing feed from their cages. During the fasting period, the rats were examined for health and weighed (initial). Individual doses were calculated based on these body weights, taking into account the specific gravity (determined by PSL) of the test substance. Each animal received the appropriate amount (500, 1,500 or 5,000 mg/kg) of the test substance by intubation using a stainless steel ball-tipped gavage needle attached to an appropriate syringe. After administration, each animal was returned to its designated cage. Feed was replaced approximately 3 to 3.5 hours after dosing of the 500 and 1,500 mg/kg dose groups.

The animals were observed for mortality, signs of gross toxicity and behavioral changes at approximately one hour post dosing and at least once daily for 14 days. Body weights were recorded prior to initiation and at termination (Day 14) or after death. Surviving rats were euthanized by $CO_2$ inhalation on Day 14. Gross necropsies were performed on all decedents. Tissues and organs of the thoracic and abdominal cavities were examined.

Results

A summary of mortality data is present in Table E1. Individual body weights, doses and mortality are presented in Tables E2, E4 and E7. Individual cage-side observations are present in Tables E3, E5 and E8. Individual necropsy observations are present in Tables E6 and E9.

TABLE E1

| SUMMARY OF MORTALITY DATA | | | |
|---|---|---|---|
| Dose Level | Mortality | | |
| Mg/kg | Males | Females | Total |
| 500 | 0/5 | 0/5 | 0/10 |
| 1,500 | 0/5 | 1/5 | 1/10 |
| 5,000 | 5/5 | 5/5 | 10/10 |

TABLE E2

| INDIVIDUAL BODY WEIGHTS AND DOSES (500 mg/kg) | | | | |
|---|---|---|---|---|
| Animal | | Body weight (g) | | Dose[6] |
| No. | Sex | Initial | Day 14 | mL |
| 4165 | M | 218 | 337 | 0.11 |
| 4166 | M | 234 | 340 | 0.12 |
| 4167 | M | 237 | 362 | 0.12 |
| 4168 | M | 216 | 331 | 0.11 |
| 4169 | M | 220 | 335 | 0.11 |
| 4170 | F | 172 | 244 | 0.086 |
| 4171 | F | 192 | 253 | 0.096 |
| 4172 | F | 182 | 236 | 0.091 |
| 4173 | F | 168 | 235 | 0.084 |
| 4174 | F | 180 | 240 | 0.090 |

[6]Administered as received Specific Gravity - 1.001 g/ml.

TABLE E3

| INDIVIDUAL CAGE-SIDE OBSERVATIONS (500 mg/kg) | | |
|---|---|---|
| Animal Number | Findings | Day of Occurrence |
| Males | | |
| 4165, 4168, 4169 | Active and healthy | 0 (1 hr)–14 |
| 4166, 4167 | Hypoactive | 0 (1 hr) |
| | Active and healthy | 0 (3 hr)–14 |
| Females | | |
| 4170, 4172–4174 | Active and healthy | 0 (1 hr)–14 |
| 4171 | Hypoactive | 0 (1–3 hr) |
| | Active and healthy | 0 (5 hr)–14 |

500 mg/kg

All animals survived and gained body weight during the study. With the exception of hypoactivity noted in three rats between one and three hours post-doing, all animals appeared active and healthy over the 14-day observation period. There were no other signs of gross toxicity, adverse pharmacologic effects of abnormal behavior.

TABLE E4

INDIVIDUAL BODY WEIGHTS, DOSES AND MORTALITY (1,500 mg/kg)

| | | Body weight (g) | | | Mortality | |
|---|---|---|---|---|---|---|
| Animal No. | Sex | Initial | Day 14 | Dose[7] | Day | Weight |
| 4775 | M | 216 | 344 | 0.32 | E | — |
| 4776 | M | 219 | 329 | 0.33 | E | — |
| 4777 | M | 211 | 334 | 0.32 | E | — |
| 4778 | M | 226 | 351 | 0.34 | E | — |
| 4779 | M | 229 | 331 | 0.34 | E | — |
| 4780 | F | 169 | 236 | 0.25 | E | — |
| 4781 | F | 163 | 229 | 0.24 | E | — |
| 4782 | F | 171 | 238 | 0.26 | E | — |
| 4783 | F | 178 | 247 | 0.27 | E | — |
| 4784 | F | 175 | — | 0.26 | 2 | 168 |

E - Euthanized via $CO_2$ inhalation after weighing on Day 14
[7]Administered as received. Specific Gravity - 1.001 g/ml.

TABLE E5

INDIVIDUAL CAGE-SIDE OBSERVATIONS (1,500 mg/kg)

| Animal Number | Finding | Day of Occurrence |
|---|---|---|
| MALES | | |
| 4775 | Hypoactive | 0 (1–5 hr) |
| | Reduced fecal volume | 1 |
| | Active and healthy | 2–14 |
| 4776, 4779 | Active and healthy | 0 (1–3 hr), 1–14 |
| | Piloerection | 0 (5 hr) |
| 4777 | Hypoactive | 0 (1–5 hr) |
| | Diarrhea | 0 (5 hr) |
| | Ano-genital staining | 0 (5 hr)–1 |
| | Reduced fecal volume | 2 |
| | Active and healthy | 3–14 |
| 4778 | Active and healthy | 0 (1 hr)–14 |
| FEMALES | | |
| 4780 | Active and healthy | 0 (1 hr), 2–14 |
| | Hypoactive | 0 (3–5 hr) |
| | Reduced fecal volume | 1 |
| 4781 | Hypoactive | 0 (1–3 hr) |
| | Active and healthy | 0 (5 hr)–14 |
| 4782 | Hypoactive | 0 (1–5 hr) |
| | Reduced fecal volume | 1–2 |
| | Active and healthy | 3–14 |
| 4783 | Active and healthy | 0 (1 hr)–14 |
| 4784 | Hunched posture, hypoactive | 0 (1 hr)–1 |
| | Piloerection | 0 (5 hr)–1 |
| | Reduced fecal volume | 1 |
| | Dead | 2 |

TABLE E6

INDIVIDUAL NECROPSY OBSERVATIONS (1,500 mg/kg)

| Animal Number | Tissue | Findings |
|---|---|---|
| FEMALE | | |
| 4784 | Lungs | Moderately red |
| | Gastrointestinal tract | Red/black |

1,500 mg/kg

One female died within two days of test substance administration. Toxic signs noted prior to death included piloerection, hunched posture, hypoactivity and a reduced fecal volume. Most of the surviving animals exhibited piloerection, hypoactivity, ano-genital staining, diarrhea and/or a reduced fecal volume, but recovered by Day 3 and appeared active and healthy over the remainder of the 14-day observation period. All survivors gained body weight over the 14-day observation period. Gross necropsy of the decedent revealed discoloration of the lungs and gastrointestinal tract.

TABLE E7

INDIVIDUAL BODY WEIGHTS, DOSES AND MORTALITY (1,500 mg/kg)

| | | Body weight (g) | | Dose[8] | Mortality | |
|---|---|---|---|---|---|---|
| Animal No. | Sex | Initial | Day 14 | ml | Day | Weight |
| 4500 | M | 190 | — | 0.95 | 0 | 187 |
| 4501 | M | 188 | — | 0.94 | 0 | 185 |
| 4502 | M | 208 | — | 1.0 | 0 | 206 |
| 4503 | M | 195 | — | 0.98 | 0 | 192 |
| 4504 | M | 187 | — | 0.94 | 0 | 183 |
| 4505 | F | 162 | — | 0.81 | 0 | 160 |
| 4506 | F | 158 | — | 0.79 | 0 | 155 |
| 4507 | F | 164 | — | 0.82 | 0 | 160 |
| 4508 | F | 162 | — | 0.81 | 0 | 158 |
| 4509 | F | 165 | | 0.83 | 0 | 163 |

[8]Administered as received. Specific Gravity - 1.001 g/ml.

TABLE E8

INDIVIDUAL CAGE-SIDE OBSERVATIONS (5,000 mg/kg)

| Animal Number | Finding | Day of Occurrence |
|---|---|---|
| MALES | | |
| 4500, 4501, | Prone, hypoactive | 0 (0.5–1 hr) |
| 4504 | Dead | 0 (3 hr) |
| 4502 | Prone, hypoactive | 0 (0.5–1 hr) |
| | Dead | 0 (1 hr) |
| 4503 | Hunched posture, hypoactive | 0 (0.5–1 hr) |
| | Dead | 0 ( 3 hr) |
| FEMALES | | |
| 4505, 4506, | Prone, hypoactive | 0 (0.5 hr) |
| 4508 | Dead | 0 (1 hr) |
| 4507, 4509 | Prone, hypoactive | 0 (0.5–1 hr) |
| | Dead | 0 (3 hr) |

TABLE E9

INDIVIDUAL NECROPSY OBSERVATIONS (5,000 mg/kg)

| Animal Number | Tissue | Findings |
|---|---|---|
| MALES | | |
| 4500, 4501, 4503, 4504 | Lungs | Slightly red |
| | Gastrointestinal tract | Extremely red |
| 4502 | Lungs | Slightly red |
| | Gastrointestinal tract | Red |
| FEMALES | | |
| 4505–4509 | Lungs | Slightly red |
| | Gastrointestinal tract | Extremely red |

5,000 mg/kg

All animals died within three hours of test substance administration. Toxic signs noted prior to death included hunched or prone posture and hypoactivity. Gross necropsy of the decedents revealed discoloration of the lungs and gastrointestinal tract.

Conclusion

Based on the finding summarized above, the acute oral $LD_{50}$ of the aqueous coil cleaner of the present invention is 1,900 mg/kg.

The foregoing description of the specific embodiments will so fully reveal the general nature of the invention that others can, by applying current knowledge, readily modify and/or adapt for various applications such specific embodiments without undue experimentation and without departing from the generic concept. Therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying our various disclosed functions make take a variety of alternative forms without departing from the invention. Thus, the expressions "means to. . ." and "means for . . . " as may be found in the specification above and/or in the claims below, followed by a functional statement, are intended to define and cover whatever structural, physical, chemical, or electrical element or structures which may now or in the future exist for carrying out the recited function, whether or not precisely equivalent to the embodiment or embodiments disclosed in the specification above; and it is intended that such expressions be given their broadest interpretation.

What is claimed is:

1. An aqueous cleaning composition comprising:

a. from about 0.1% to about 10% by weight of an acidic metal cleaning compound selected from the group consisting of ammonium bifluoride, alkali metal fluorides, ammonium fluoride, potassium bifluoride, soduim bifluoride, calcium fluorophosphate, and sodium fluorosilicates, and mixtures thereof;

b. at least one nitrogen containing compound to provide a stabilized pH wherein the at least one nitrogen containing compound is present in an amount such that the pH of the composition is between about 3.5 and about 7.0, and the pH of the composition depends on the amount of at least one nitrogen containing compound present;

c. from 3% to 17.8% by weight of a terpene emulsifying agent; and d. from 1% to 5% by weight of at least one nonionic surfactant.

2. The aqueous cleaning composition according to claim 1 wherein the nonionic surfactant is selected from the group consisting of ethoxylated alcohols, alkoxylated compounds produced by condensing alkylene oxide groups with an organic hydrophobic compounds, polythylene oxide condensates of alkyl phenols, condensation products of primary or secondary aliphatic alcohols with alklene oxide, and mixtures thereof.

3. The aqueous cleaning composition according to claim 1 wherein the nonionic surfactant is a nonylphenol polyglycol ether.

4. The aqueous cleaning composition according to claim 1 wherein the acidic metal cleaning compound is ammonium bifluoride.

5. The aqueous cleaning composition according to claim 1 wherein the nitrogen containing compound is an alkanolamide.

6. The aqueous cleaning composition according to claim 1 comprising 4% by weight ammonium bifluoride, 4% by weight nonyl phenol ethoxylate, 4% by weight terpene emulsifying agent, and 1.25% by weight modified coconut diethanolamide.

7. The aqueous cleaning composition according to claim 1 comprising 4% by weight ammonium bifluoride, 4% by weight nonyl phenol ethoxylate, 4% by weight terpene emulsifying agent, and 0.75% by weight modified coconut diethanolamide.

8. The aqueous cleaning composition according to claim 1 comprising from 1 to 4% by weight ammonium bifluoride.

9. The aqueous cleaning composition according to claim 1 further comprising at least one water soluble solvent selected from the group consisting of glycol ethers, lactones, and mixtures thereof.

10. The aqueous cleaning composition according to claim 1 wherein the at least one nitrogen containing compound is selected from the group consisting of alkanolamines, pyrrolidones, EDTA and salts thereof, NTA and salts thereof, modified imidzaoline derivatives, alkanolamides, and mixtures thereof.

11. The aqueous cleaning composition according to claim 1 wherein the at least one nitrogen containing compound is present in an amount of from about 0.04 to about 15% by weight, and further comprising up to about 15% by weight of at least one water soluble solvent having a vapor pressure of less than 4 mm Hg at 20° C.

12. The aqueous cleaning composition according to claim 1 wherein the at least one nitrogen containing compound is selected form the group consisting of alkanolamines, pyrrolidones, EDTA and salts thereof, NTA and salts thereof, modified imidazoline derivatives, alkanolamides, and mixtures thereof.

13. The aqueous cleaning composition according to claim 1 wherein the at least one nitrogen containing compound is selected from the group consisting of diethanolamide, triethanolamine, and mixtures thereof.

14. The aqueous cleaning composition according to claim 1 further comprising a second nonionic surfactant which is capable of emulsifying a terpene.

* * * * *